US005596306A

United States Patent [19]

Kowalik et al.

[11] Patent Number: 5,596,306

[45] Date of Patent: Jan. 21, 1997

[54] FORM FITTING ARC BARRIER FOR FUSE LINKS

[75] Inventors: Joseph W. Kowalik, Skokie; Heraclio R. Gomez, Northbrook, both of Ill.

[73] Assignee: Littelfuse, Inc., Des Plaines, Ill.

[21] Appl. No.: 472,406

[22] Filed: Jun. 7, 1995

[51] Int. Cl.[6] ..... H01H 85/38

[52] U.S. Cl. ..... 337/282; 337/165

[58] Field of Search ..... 337/163–164, 337/165, 260, 270, 276, 282

[56] References Cited

U.S. PATENT DOCUMENTS 4,533,895 8/1985 Kowalik et al. ..... 337/165

4,636,765 1/1987 Krueger ..... 337/273

5,245,308 9/1993 Herbias ..... 337/273

5,345,210 9/1994 Swensen et al. ..... 337/163

*Primary Examiner*—Leo P. Picard

*Assistant Examiner*—Jayprakash N. Gandhi

*Attorney, Agent, or Firm*—Wallenstein & Wagner, Ltd.

[57] ABSTRACT

Fuses and a subassembly component for fuses. The fuse includes an insulating housing, a short circuit fusible element, and an arc barrier-forming body. The arc barrier-forming body is fitted around, and intimately surrounds a portion of the short-circuit fusible element. The arc barrier-forming body is formed from a silicone rubber sealant which is free flowing at room temperature but upon exposure to air increases in viscosity until it essentially becomes a solid. The arc barrier-forming body provides protection against "burn-back" within the fuse.

27 Claims, 3 Drawing Sheets

FORM FITTING ARC BARRIER FOR FUSE LINKS

TECHNICAL FIELD

The present invention is related to the use of an initially free-flowing silicone material as an arc barrier-forming body in fuses.

BACKGROUND OF THE INVENTION

Both fast acting and time delay fuses are well known in the fuse industry. One example of a typical time delay fuse is the fuse disclosed in U.S. Pat. No. 5,345,210 ('210 patent), the disclosure of which is incorporated herein by reference. The '210 patent, which is assigned to the assignee of the present application, is directed to a time delay fuse and various components of that time delay fuse. The fuse includes a housing made of an insulating material. First and second conductive terminals are secured to, and emerge from the opposite ends of the housing. The housing encloses a short-circuit fusible element, preferably a copper or copper alloy strip having a plurality of slots. The housing also encloses one or more rigid meltable fusible elements, preferably a plurality of solder bars. A body of resilient, compressible insulating material has at least one passageway through which each of the rigid meltable fusible elements extends. A quantity of pulverulent arc quenching material, preferably sand, is enclosed within the housing. When the rigid meltable fusible elements melt, the circuit through the fuse opens. In addition, the passageway which surrounded the rigid meltable fusible element collapses upon its melting. The closing of the passageway, and the sand enclosed within the housing aids in preventing arcs formed during the opening of the fuse from a condition known as "burn back," i.e., the movement of an arc through the length of the fuse. These features alone, however, are not always successful at eliminating potentially fuse damaging arcs generated within the fuse. The '210 patent does not disclose the use of an initially free-flowing silicone material as an arc barrier-forming body to prevent "burn-back."

Another time delay fuse is disclosed in U.S. Pat. No. 4,533,895 ('895 patent), the disclosure of which is incorporated herein by reference. The '895 patent, assigned to the assignee of the present invention, discloses a slow blowing or time delay fuse having one or more conducting fuse links for short-circuit blowout protection. The short-circuit blowout protecting fuse links are located at opposite longitudinal ends of the fuse in individual end chambers. These individual end chambers are contained and defined by a cup-shaped end cap and a washer. Each of these individual end chambers is filled with an arc-quenching filler, such as sand. The washer prevents sand from entering a central compartment or chamber.

While the end chambers of the '895 patent provide short-circuit blowout protection, the central compartment or chamber provides a more massive fuse link structure which provides blowout protection for prolonged, but relatively low, current overloads. The more massive fuse link structure within the central compartment includes a plunger, a plunger guide member, and a conically-shaped compressed coil spring. The '895 patent discloses a time delay blade terminal-type fuse which provides both short circuit protection and a time delayed protection under prolonged modest overload currents, however, the '895 patent does not disclose the use of an initially free-flowing silicone material as an arc barrier-forming body to protect against "burn-back" within the fuse.

Nevertheless, efforts have been made to include arc barrier-forming bodies to provide protection against "burn-back" in both fast acting and time delay fuses. These prior arc barrier-forming bodies have been formed from initially solid silicone rubber. A slit was cut in the solid silicone rubber body, and the fusible short-circuit element was manually inserted, and slid through the slit. Such a procedure, however, is time consuming and expensive. Also, during this procedure, the fusible short-circuit element was susceptible to axial movement which could damage not only the short-circuit element, but also the connections between components of the fuse. Prior arc barrier-forming bodies were also very difficult to slide onto fusible short-circuit elements that did not have generally flat, straight configurations. Moreover, because prior arc barrier-forming bodies did not adhere to the surface of the fusible short-circuit element, when the housing was filled with sand, the arc barrier-forming bodies had a tendency to move.

Other prior art of interest includes U.S. Pat. No. 5,245,308 ('308 patent), issued to Herbias, and assigned to the assignee of the present application. The '308 patent discloses a Class L fuse with an insulating, initially free-flowing sealant which acts as an arc barrier-forming body disposed at the end portions of the assembled housing. The '308 patent also fails to teach the use of an initially free-flowing material in the manner of the present invention. Particularly, the '308 patent fails to teach placing the arc barrier-forming body on an intermediate portion of the fusible short-circuit element in a Class R fuse.

SUMMARY OF THE INVENTION

The present invention is directed to the use of an initially free-flowing silicone material as an arc barrier-forming body in fuses. The arc barrier-forming material is preferably a silicone rubber sealant which is free-flowing at room temperature but, upon exposure to air, increases in viscosity until it essentially becomes a solid. The arc barrier-forming material is applied in its plastic or slurry-like state around an intermediate portion of the short-circuit fusible element of the fuse. The arc barrier-forming body acts as a physical barrier preventing any arc created during opening of the fuse from reaching and damaging the end terminals.

In one aspect of the present invention, a subassembly component for a fuse is provided. The subassembly component comprises a short-circuit fusible element having first and second opposite ends, and an arc barrier-forming body fitted around and intimately surrounding an intermediate portion of the short-circuit fusible element. The arc barrier-forming body is formed from a silicone rubber sealant which is free flowing at room temperature but upon exposure to air increases in viscosity until it essentially becomes a solid.

In another aspect of the present invention, a time delay fuse is provided. The time delay fuse comprises a housing with first and second conductive terminals at opposite axial ends of the housing, a short-circuit fusible element, a time delay fusible element, and an arc barrier-forming body. The short-circuit fusible element is located within the housing, and has first and second opposite ends, the first end being conductively connected to the first terminal. The time delay fusible element is also located within the housing, and is conductively secured between the second end of the short-circuit fusible element and the second terminal. The arc barrier-forming body is fitted around, and intimately surrounds a portion of the short-circuit fusible element intermediate the first and second ends. The arc barrier-forming body is formed from a silicone rubber sealant which is free flowing at room temperature but upon exposure to air increases in viscosity until it essentially becomes a solid.

In yet another aspect of the present invention, a fast acting fuse is provided. The fast acting fuse comprises a housing with first and second conductive terminals at opposite axial ends of the housing, a short-circuit fusible element, and an arc barrier-forming body. The short-circuit fusible element is located within the housing, and has first and second opposite ends. The first and second opposite ends are connected to the first and second conductive terminals. The arc barrier-forming body is fitted around, and intimately surrounds a portion of the short-circuit fusible element intermediate the first and second ends. The arc barrier-forming body is formed from a silicone rubber sealant which is free flowing at room temperature but upon exposure to air increases in viscosity until it essentially becomes a solid.

The housing of the time delay and fast acting fuses of the present invention may be entirely filled with a pulverulent arc-quenching material. Preferably, that pulverulent arc-quenching material is sand.

Objects of the present invention include the use of an initially free-flowing material which acts as an arc barrier-forming body in fuses. The arc barrier-forming body is formed from a silicone rubber sealant which is free flowing at room temperature but, upon exposure to air, increases in viscosity until it essentially becomes a solid. Another object of the invention is the use of an arc barrier-forming body which may be quickly and inexpensively applied to a portion of the short-circuit fusible element intermediate the first and second ends in a fuse. A further object of the invention is the use of an arc barrier-forming body which does not expose the short-circuit fusible element of a fuse to axial movement upon application.

A still further object of the invention is the use of an arc barrier-forming body which adheres to the surface of the short-circuit fusible element of a fuse. Thus, upon filling the housing of the fuse with an arc-quenching pulverulent material, preferably sand, the arc barrier-forming body does not move.

Yet another object of the invention is the use of an arc barrier-forming body which can be easily applied to short-circuit fusible elements of varying configurations in fuses so that the arc barrier-forming body conforms to the shape of the short-circuit fusible element of the fuse.

BRIEF DESCRIPTION OF THE DRAWINGS

The present invention will be better understood from the following detailed description taken in conjunction with the accompanying drawings, wherein.

DETAILED DESCRIPTION

The present invention is related to the use of an initially free-flowing silicone material as an arc barrier-forming body in fuses.

Figure 1:
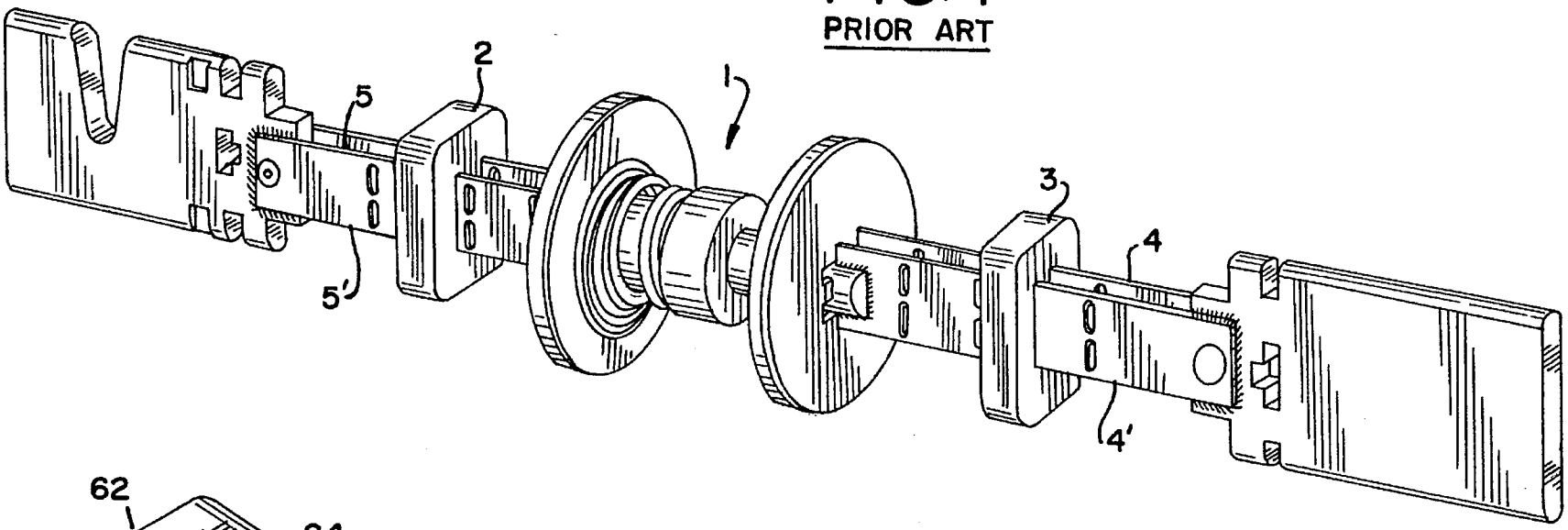
FIG. 1 PRIOR ART
FIG. 1 is a perspective view of a prior art fuse having initially solid arc barrier-forming bodies.

FIG. 1 shows a perspective view of a prior art time delay fuse 1. The arc barrier-forming bodies 2 and 3 are formed from initially solid silicone rubber. The short-circuit fusible elements 4, 4' and 5, 5' are manually inserted into, and slid through, slits in the solid silicone rubber bodies 2 and 3.

The use of an initially free-flowing silicone material as an arc barrier-forming body in fuses, and various elements and subassembly components of these fuses are illustrated in FIGS. 2–7. The initially free-flowing silicone material of the present invention can be used as arc barrier-forming bodies in both time delay and fast acting fuses. For example, the present invention can be applied to the time delay fuse disclosed in U.S. Pat. No. 4,533,895, issued to Kowalik et al, and assigned to the assignee of the present invention.

In a preferred embodiment, however, initially free-flowing silicone material is used as an arc barrier-forming body in a time delay fuse such as the one disclosed in U.S. Pat. No. 5,345,210, issued to Swensen et al., and assigned to the assignee of the present invention.

Figure 4:
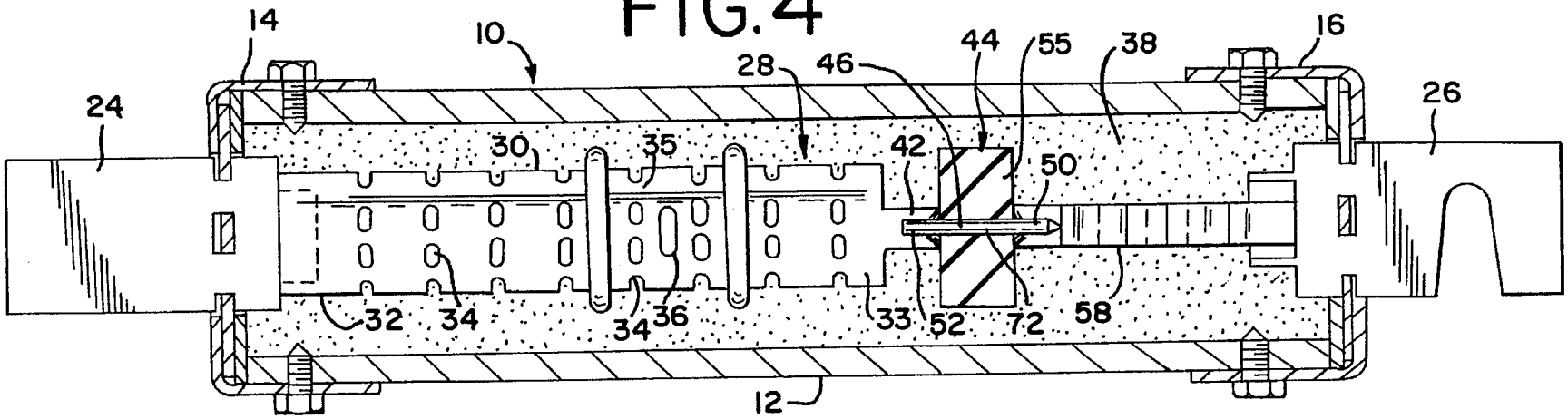
FIG. 4 is a top, cutaway view of a preferred embodiment of a time delay fuse according to the present invention, and showing its components.

FIG. 4 illustrates the initially open-ended cylindrical housing 12 of fuse 10, which housing is made of a suitable, conventional insulating material. Secured over the initially open ends of housing 12 are a pair of cup-shaped end caps 14 and 16. Apertures (not illustrated) are provided in the ends of end caps 14 and 16, through which project first and second knife-blade terminals 24 and 26. Terminals 24 and 26 are guided through the apertures in end caps 14 and 16, and emerge from the opposite axial ends of housing 12.

Figure 2:
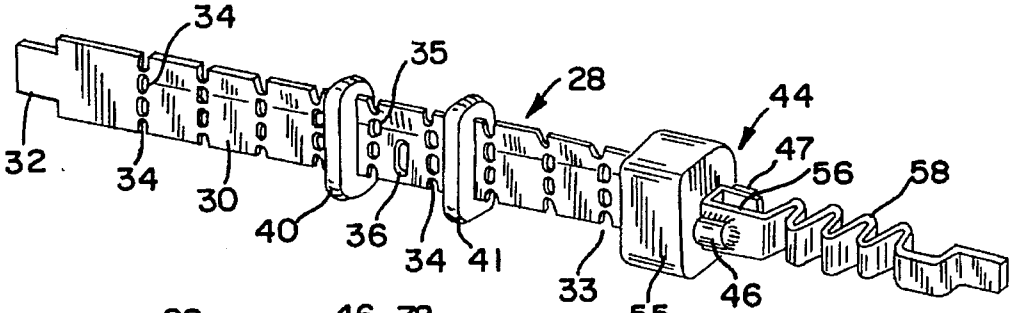
FIG. 2 is a perspective view of a subassembly component for a time delay fuse according to the present invention.
Figure 3:
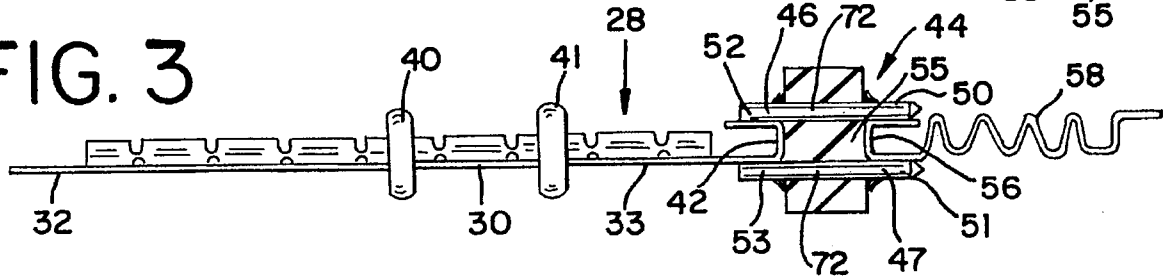
FIG. 3 is a view of the time delay fuse subassembly component of FIG. 2 but with the fuse turned 90° about its longitudinal axis.

Terminals 24 and 26 are electrically connected to a subassembly component 28 of fuse 10. Subassembly component 28, illustrated in FIGS. 2–4, is enclosed in the housing 12 and includes a short-circuit fusible element 30. Short-circuit fusible element 30 includes first and second opposite ends 32 and 33, and can be formed from a strip of conductive metal or metal alloy, preferably copper or silver. If short-circuit fusible element 30 is formed from a copper alloy strip, then the preferred copper alloy is nickel-copper or zinc-copper. First opposite end 32 is conductively connected, as by welding or soldering, to a top or bottom surface of first conductive terminal 24.

Referring now to FIGS. 2 and 4, short-circuit fusible element 30 includes elongated slots 34 which form current flow restrictions in element 30. The combination of these slots 34 and the adjacent, remaining solid portion of the element 30 form what are commonly known as bridges 35. A single, somewhat larger elongated slot 36 is positioned near the center of the short-circuit fusible element 30. This larger elongated slot 36, along with the closest conventional slot 34, increase the resistance at a central zone of the short-circuit fusible element 30 to a level above that of any other portion of the element 30. As a result, there is an increased likelihood of the fuse blowing in this central zone of the short-circuit fusible element 30. This is desirable, since any arc formed in this central zone upon blowing of the element 30 must then travel the longest possible distance before reaching either of the terminals 24 and 26. This increases the likelihood that the arc will be quenched prior to reaching the terminals 24 and 26. In a preferred embodiment, quenching is facilitated by an arc-quenching pulverulent material 38, preferably common silica sand.

Referring to FIGS. 2–4, arc barrier-forming bodies 40 and 41 are fitted around, and intimately surround intermediate portions of the short-circuit fusible element 30. The arc barrier-forming bodies 40 and 41 are formed from a silicone rubber sealant which is free flowing at room temperature but upon exposure to air increase in viscosity until they essentially become a solid.

Arc barrier-forming body 40 adheres to the surface of the short-circuit fusible element 30, and is disposed intermediate the first opposite end 32 of short-circuit element 30 and the central zone of short-circuit fusible element 30 where there is an increased likelihood of the fuse blowing (i.e., intermediate end 32 and larger elongated slot 36). This location of arc barrier-forming body 40 is preferred, since end terminal 24 is protected from any arc created in the central zone of the short-circuit fusible element 30 by the arc barrier-forming body 40.

Arc barrier-forming body 41 also adheres to the surface of the short-circuit fusible element 30, and is disposed intermediate the second opposite end 33 of the short-circuit element 30 and the central zone of the short-circuit fusible element 30 where there is an increased likelihood of the fuse blowing (i.e., intermediate end 33 and larger elongated slot 36). This location of arc barrier-forming body 41 is also preferred, since end terminal 26 is protected from any arc created in the central zone of the short-circuit fusible element 30 by the arc barrier-forming body 41.

In a another embodiment of the present invention (not illustrated) a plurality of arc barrier-forming bodies 40 are disposed intermediate the first opposite end 32 of short-circuit fusible element 30 and the central zone of the short-circuit fusible element 30. In the same embodiment, a plurality of arc barrier-forming bodies 41 are disposed intermediate the second opposite end 33 of short-circuit fusible element 30 and the central zone of short-circuit fusible element 30. This provides maximum protection from any arc created in the central zone of short-circuit fusible element 30.

The preferred arc barrier-forming material is sold under the trade name RTV Silicone Rubber, Catalog No. RTV 162, White, EC 779. This product is manufactured by General Electric Company, Silicone Products Division, Waterford, N.Y. 12188. This RTV sealant is free-flowing at room temperature and moves in a manner similar to that of a viscous liquid or slurry. After exposure to air, the RTV sealant cures and hardens, increasing in viscosity until it essentially becomes a solid.

The arc barrier-forming material is applied to short-circuit fusible element 30 in its plastic or slurry-like state. Essentially, the material comprising arc barrier-forming bodies 40 and 41 is form-fitted around its environment and conforms to the shape of short-circuit fusible element 30. The arc barrier-forming material completely and intimately surrounds intermediate portions of short-circuit fusible element 30.

With reference to FIG. 3, short-circuit fusible element 30 includes a C-shaped portion 42. C-shaped portion 42 ensures good mechanical and electrical contact with another fuse component, i.e., the time delay fusible element 44.

Referring to FIG. 4, time delay fusible element 44 is enclosed in housing 12, and is conductively secured between the C-shaped portion 42 of short-circuit element 30 and second terminal 26 of housing 12. Time delay fusible element 44 and short-circuit fusible element 30 preferably are longitudinally spaced and extend along a first longitudinal axis "A" of housing 12.

In a preferred embodiment illustrated in FIG. 3, time delay fusible element 44 comprises one or more meltable fusible elements, such as bodies of solder 46 and 47. While FIG. 3 illustrates two solder bodies 46 and 47, time delay fusible element 44 may comprise more than two solder bodies depending on the rating of the fuse. Each body of solder 46 and 47 in FIG. 3 is generally cylindrical in shape, and has a cone-shaped end 50 and 51. Cone-shaped ends 50 and 51 facilitate insertion of solder bodies 46 and 47 into a body of resilient, compressible insulating material 55. The non-cone-shaped ends 52 and 53 of solder bodies 46 and 47 are soldered or spot-welded to the C-shaped portion 42 of short-circuit fusible element 30. The material for solder bodies 46 and 47 can vary, but the preferred materials include 51.2 percent tin, 30.6 percent lead, and 18.2 percent cadmium solid wire solder. Another preferred composition includes 63 percent tin and 37 percent lead solid wire solder. The body of resilient, compressible insulating material 55 may be an elastomer. The preferred elastomer is a silicone rubber with a durometer hardness of 10.

In a preferred embodiment, the portions of solder bodies 46 and 47 adjacent cone-shaped ends 50 and 51 are secured by soldering or spot welding to a C-shaped portion 56 of a heater element 58. The present invention also includes fuse assemblies without heater element 58. In such an embodiment, heater element 58 could be replaced by a fusible element similar to short circuit fusible element 30 (this embodiment is not illustrated). Securement of solder bodies 46 and 47 in this manner ensures that there is good physical and electrical contact between solder bodies 46 and 47, and heater element 58.

In the preferred embodiment, illustrated in FIGS. 2–4, heater element 58 is corrugated and comprised of copper or a copper alloy. Also in a preferred embodiment, heater element 58 while somewhat narrower and appreciably shorter than short-circuit fusible element 30, has more mass than short-circuit fusible element 30 due to its corrugated configuration. Thus, short-circuit overloads are not likely to result in blowing of heater element 58. The corrugated configuration of heater element 58, illustrated in FIGS. 2–4, also makes the heater element more flexible, and improves the overall mechanical shock properties of fuse 10. However, heater element 58 can comprise any geometric configuration.

To complete the circuit through fuse 10, the end of heater element 58 opposite C-shaped portion 56 is soldered or spot-welded to a top or bottom surface of second terminal 26.

In this specification, the term "compressible" is intended to refer to a material which may collapse upon and obscure any relatively small openings which are formed in a block of that material. Particularly, for the purposes of this invention, a compressible material is one in which (1) a relatively small hole may be formed with a hole-forming instrument; and, (2) when the hole-forming instrument is removed from that hole, the surrounding compressible material will collapse upon and obscure that hole.

This specification gives certain preferred dimensions for components of the fuses in accordance with the invention. The dimensions stated are suitable for fuses rated at between 70 and 600 amperes.

FIGS. 2–4 and 8 illustrate a preferred body of resilient, compressible insulating material 55 having a length (L) of 0.750 inches, a width (W) of 0.650 inches and a thickness (T) of 0.750 inches. Two holes, each having a diameter of 0.030 inches are molded into the 0.375 inch thickness of body 55. This molding forms two passageways 60 and 62 through which solder bars 46 and 47 extend (illustrated in FIG. 3). Each of the passageways 60 and 62 are defined by surrounding walls. Upon the melting of solder bodies 46 and 47, the walls collapse because of the resiliency of the body of resilient, compressible insulating material 55. In this manner, passageways 60 and 62 are virtually completely obscured, leaving visible only two small points where the hole-forming instrument entered the body of resilient, compressible insulating material 55. The complete closing of passageways 60 and 62 is not necessary to effect interruption of the circuit in fuse 10. Interruption of the circuit in fuse 10 occurs when solder bodies 46 and 47 melt. The closing of passageways 60 and 62 aids in preventing arcs formed during the opening of fuse 10 from "burn-back." As mentioned previously, protection against "burn-back" is also provided by arc-quenching pulverulent material 38, which acts as an arc quencher, and the arc barrier-forming bodies 40 and 41, which act as physical arc barriers within housing 12 of fuse 10.

Figure 8:
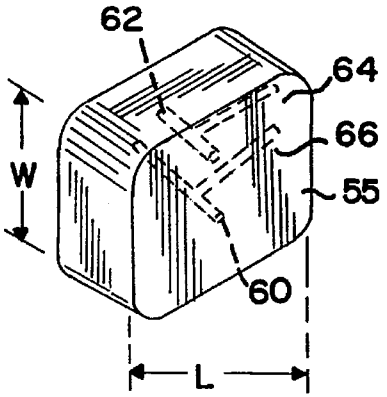
FIG. 8 is an enlarged perspective view of the body of resilient, compressible insulating material shown in FIGS. 2–4, but without the solder bodies normally contained within that material.

As illustrated in FIG. 8, the body of resilient, compressible insulating material 55 includes two elongated vent holes 64 and 66. Vent holes 64 and 66 have a diameter of 0.110 inches, and are drilled or punched into the body of resilient, compressible insulating material 55. Vent holes 64 and 66 begin at the outer periphery of resilient, compressible insulating material 55, and move inwardly towards solder bodies 46 and 47. Vent holes 64 and 66 provide for pressure relief by permitting an escape path for the molten solder upon the melting of solder bodies 46 and 47. Particularly, any molten solder can move outwardly from the site of solder bodies 46 and 47 through any one of vent holes 64 and 66 into the arcquenching pulverulent material 38. After drilling, vent holes 64 and 66 collapse due to the resiliency of the body of resilient, compressible insulating material 55. Vent holes 64 and 66, however, open under appropriate circumstances to provide the above-described pressure relief for the escape of molten solder.

With reference to FIGS. 3 and 4, solder bodies 46 and 47 of the time delay fusible element 44 include a pair of end portions 50, 51 and 52, 53. Between end portions 50, 51 and 52, 53 of each solder body is a central portion 72. Central portions 72 of each solder body 46 and 47 are retained within passageways 60 and 62 of the body of resilient, compressible insulating material 55, while end portions 50, 51 and 52, 53 of solder bodies 46 and 47 project axially beyond the body of resilient, compressible insulating material 55. In one embodiment, each solder body 46 and 47 has an overall length of 0.906 inches and a diameter of 0.120 inches. Of this 0.906 inch length, 0.835 inches is a completely cylindrical portion, while the cone-shaped end portion measures 0.071 inches in length. The angle of the surface of the cone-shaped end portion, relative to the horizontal, is approximately 40°.

Figure 5:
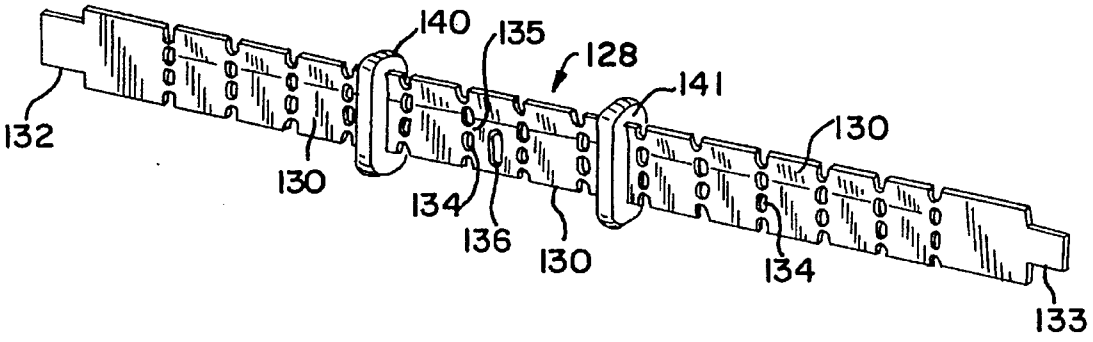
FIG. 5 is a perspective view of a subassembly component for a fast acting fuse according to the present invention.
Figure 6:
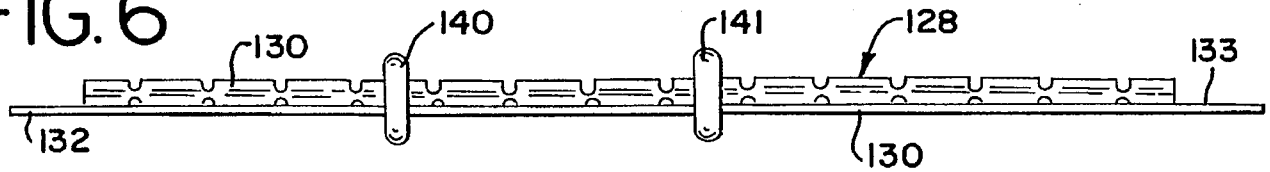
FIG. 6 is a view of the fast acting fuse subassembly component of FIG. 5 but with the fuse turned 90° about its longitudinal axis; and, FIG. 7 is a top, cutaway view of a preferred embodiment of a fast acting fuse according to the present invention, and showing its components.
Figure 7:
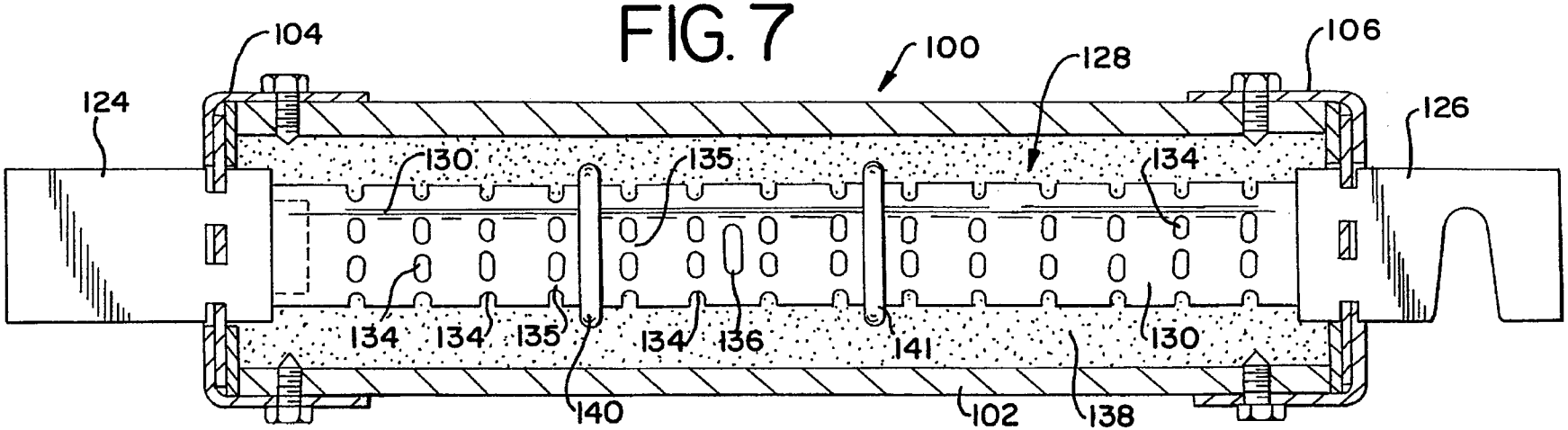

In another embodiment of the present invention, initially free-flowing silicone material is used as an arc barrier-forming body in a fast acting fuse 100. Various elements and subassembly components of fuse 100 are shown in FIGS. 5–7. FIG. 7 illustrates the initially open-ended cylindrical housing 102 of fuse 100, which housing is made of a suitable, conventional insulating material. Secured over the initially open ends of housing 102 are a pair of cup-shaped end caps 104 and 106. Apertures (not illustrated) are provided in the ends of end caps 104 and 106, through which project first and second knife-blade terminals 124 and 126. Terminals 124 and 126 are guided through the apertures in end caps 104 and 106, and emerge from opposite axial ends of housing 12.

Terminals 124 and 126 are electrically connected to a subassembly component 128 of fuse 100. The subassembly component, illustrated in FIGS. 5–7, is enclosed in housing 102 and includes a short-circuit fusible element 130. Short-circuit fusible element 130 includes first and second opposite ends 132 and 133, and can be formed from a strip of conductive metal or metal alloy, preferably copper, copper alloy or silver. If short-circuit fusible element 130 is made of a copper alloy strip, then the preferred copper alloy is nickel-copper or zinc-copper. The first opposite end 132 of short-circuit fusible element 130 is conductively connected, as by welding or soldering, to a top or bottom surface of first conductive terminal 124.

Referring to FIGS. 5 and 7, short-circuit fusible element 130 includes elongated slots 134 which form current flow restrictions in element 130. The combination of these slots 134 and the adjacent, remaining solid portion of element 130 form what are commonly known as bridges 135. A single, somewhat larger elongated slot 136 is positioned near the center of short-circuit fusible element 130. This larger elongated slot 136, along with the closest conventional slot 134, increase the resistance at a central zone of short-circuit fusible element 130 to a level above that of any other portion of element 130. As a result, there is an increased likelihood of fuse 100 blowing in the central zone of short-circuit fusible element 130. This is desirable, since any arc formed in the central zone upon blowing of element 130 must then travel the longest possible distance before reaching either knife-blade terminal 124 or 126. This increases the likelihood that the arc will be quenched prior to reaching terminals 124 or 126. In a preferred embodiment, illustrated in FIG. 7, quenching is facilitated by an arc-quenching pulverulent material 138, preferably common silica sand.

Referring now to FIGS. 5–7, arc barrier-forming bodies 140 and 141 are fitted around, and intimately surround intermediate portions of the short-circuit fusible element 130. Arc barrier-forming bodies 140 and 141 are formed from a silicone rubber sealant which is free flowing at room temperature but upon exposure to air increases in viscosity until they essentially become a solid.

Arc barrier-forming body 140 adheres to the surface of short-circuit fusible element 130, and is disposed intermediate the first opposite end 132 of short-circuit element 130 and the central zone of short-circuit fusible element 130 where there is an increased likelihood of the fuse 100 blowing (i.e., intermediate end 132 and larger elongated slot 136). This location of arc barrier-forming body 140 is preferred, since end terminal 124 is protected from any arc created in the central zone of short-circuit fusible element 130 by arc barrier-forming body 140.

Arc barrier-forming body 141 also adheres to the surface of short-circuit fusible element 130, and is disposed intermediate the second opposite end 133 of short-circuit fusible element 130 and the central zone of short-circuit fusible element 130 where there is an increased likelihood of the fuse 100 blowing (i.e., intermediate end 133 and larger elongated slot 136). This location of arc barrier-forming body 141 is preferred, since end terminal 126 is protected from any arc created in the central zone of short-circuit fusible element 130 by arc barrier-forming body 141.

In another embodiment of the present invention (not illustrated), a plurality of arc barrier-forming bodies 140 are disposed intermediate the first opposite end 132 of short-circuit fusible element 130 and the central zone of the short-circuit fusible element 130. In the same embodiment, a plurality of arc barrier-forming bodies 141 are disposed intermediate the second opposite end 133 of short-circuit fusible element 130 and the central zone of short-circuit fusible element 130. This provides maximum protection from any arc created in the central zone of short-circuit fusible element 130.

The preferred arc barrier-forming material is sold under the trade name RTV Silicone Rubber, Catalog No. RTV 162, White, EC 779. This product is manufactured by General Electric Company, Silicone Products Division, Waterford, N.Y. 12188. This RTV sealant is free-flowing at room temperature and moves in a manner similar to that of a viscous liquid or slurry. After exposure to air, the RTV sealant cures and hardens, increasing in viscosity until it essentially becomes a solid.

The arc barrier-forming material is applied to short-circuit fusible element 130 in its plastic or slurry-like state. Essentially, the material comprising arc barrier-forming bodies 140 and 141 is form-fitted around its environment and conforms to the shape of short-circuit fusible element 130. The arc barrier-forming material completely and intimately surrounds intermediate portions of short-circuit fusible element 130.

While the specific embodiments have been illustrated and described, numerous modifications come to mind without markedly departing from the spirit of the invention. The scope of protection is, thus, only intended to be limited by the scope of the accompanying claims.

We claim:

1. A fast acting fuse comprising:

a housing with first and second conductive terminals at opposite axial ends of said housing;

a short-circuit fusible element located within said housing, said short-circuit fusible element having at least one elongated slot forming a zone of increased resistance between first and second opposite ends, said first and second opposite ends connected to said first and second conductive terminals; and, an arc barrier-forming body fitted around and intimately surrounding a portion of said short-circuit fusible element adjacent said zone and intermediate said first end and said elongated slot, said arc barrier-forming body being formed from a silicone rubber sealant which is initially free flowing at room temperature but upon exposure to air increases in viscosity until it essentially becomes a solid.

2. The fast acting fuse of claim 1, wherein said arc barrier-forming body adheres to the surface of said short-circuit fusible element to prevent said arc barrier-forming body from moving.

3. The fast acting fuse of claim 1, wherein said short-circuit fusible element further comprises copper metal.

4. The fast acting fuse of claim 1, wherein said short-circuit fusible element further comprises a copper alloy metal.

5. The fast acting fuse of claim 1, wherein said short-circuit fusible element further comprises silver metal.

6. The fast acting fuse of claim 1, wherein said short-circuit fusible element further comprises at least one enlarged elongated slot adjacent said elongated slot, said enlarged elongated slot and said elongated slot encouraging blowing of said short-circuit fusible element in said zone of increased resistance upon short-circuit or high overload current conditions.

7. The fast acting fuse of claim 1 further including an arc barrier-forming body fitted around and intimately surrounding a portion of said short-circuit fusible element adjacent said zone and intermediate said second end and said elongated slot.

8. A time delay fuse comprising:

a housing with first and second conductive terminals at opposite axial ends of said housing;

a short-circuit fusible element located within said housing, said short-circuit fusible element having at least one elongated slot forming a zone of increased resistance between first and second opposite ends, said first end being conductively connected to said first terminal;

a time delay fusible element conductively secured between said second end of said short-circuit fusible element and said second terminal; and, an arc barrier-forming body fitted around and intimately surrounding a portion of said short-circuit fusible element adjacent said zone and intermediate said first end and said elongated slot, said arc barrier-forming body being formed from a silicone rubber sealant which is initially free flowing at room temperature but upon exposure to air increases in viscosity until it essentially becomes a solid.

9. The time delay fuse of claim 8 wherein said arc barrier-forming body adheres to the surface of said short-circuit fusible element to prevent said arc barrier-forming body from moving.

10. The time delay fuse of claim 8, wherein said short-circuit fusible element further comprises copper metal.

11. The time delay fuse of claim 8, wherein said short-circuit fusible element further comprises a copper alloy metal.

12. The time delay fuse of claim 8, wherein said short-circuit fusible element further comprises silver metal.

13. The time delay fuse of claim 8, wherein said short-circuit fusible element includes at least one enlarged elongated slot adjacent said elongated slot, said enlarged elongated slot and said elongated slot encouraging blowing of said short-circuit fusible element in said zone of increased resistance upon short-circuit or high overload current conditions.

14. The time delay fuse of claim 8, wherein said time delay fusible element melts to interrupt current flow when overload current flows through said time delay fusible element for a given period of time.

15. The time delay fuse of claim 14, wherein said time delay fusible element further comprises at least one body of solder.

16. The time delay fuse of claim 15, wherein said time delay fusible element further comprises a body of resilient, compressible insulating material, said body having a passageway through which said time delay fusible element extends, said passageway being defined by surrounding walls, and said walls collapsing because of the resiliency of said insulating material upon melting of said time delay fusible element.

17. The time delay fuse of claim 8 further comprising a heater element, said heater element conductively connecting said time delay fusible element with said second conductive terminal.

18. The time delay fuse of claim 8, wherein said housing encloses a pulverulent arc-quenching material.

19. The time delay fuse of claim 18, wherein said pulverulent arc-quenching material further comprises sand.

20. The time delay fuse of claim 8 further including an arc barrier-forming body fitted around and intimately surrounding a portion of said short-circuit fusible element adjacent said zone and intermediate said second end and said elongated slot.

21. A subassembly component for mounting within the housing of a fuse, said subassembly component comprising:

a short-circuit fusible element having at least one elongated slot forming a zone of increased resistance between first and second opposite ends;

an arc barrier-forming body fitted around and intimately surrounding a portion of said short-circuit fusible element adjacent said zone and intermediate said first end and said elongated slot, said arc barrier-forming body being formed from a silicone rubber sealant which is initially free flowing at room temperature but upon exposure to air increases in viscosity until it essentially becomes a solid.

22. The subassembly component of claim 21, wherein said arc barrier-forming body adheres to the surface of said short-circuit fusible element to prevent said arc barrier-forming body from moving.

23. The subassembly component of claim 21, wherein said short-circuit fusible element further comprises copper metal.

24. The subassembly component of claim 21, wherein said short-circuit fusible element further comprises a copper alloy metal.

25. The subassembly component of claim 21, wherein said short-circuit fusible element further comprises silver metal.

26. The subassembly component of claim 21, wherein said short-circuit fusible element further comprises at least one enlarged elongated slot adjacent said elongated slot, said enlarged elongated slot and said elongated slot encouraging blowing of said short-circuit fusible element in said zone of increased resistance upon short-circuit or high overload current conditions.

27. The subassembly component of claim 21 further including an arc barrier-forming body fitted around and intimately surrounding a portion of said short-circuit fusible element adjacent said zone and intermediate said second end and said elongated slot.

* * * * *